United States Patent [19]

Dalo et al.

[11] Patent Number: 4,690,161

[45] Date of Patent: Sep. 1, 1987

[54] METHOD AND DEVICE FOR MOUNTING THE POLE AND CLOTH OF A LIGHT SHELTER WITH CENTRAL POLE

[76] Inventors: Jean Dalo, Rue Beaurepaire, 91410-Roinville-sur-Dourdan; Pierre Dalo, 153, rue de Fleury, 92140-Clamart, both of France

[21] Appl. No.: 746,270

[22] Filed: Jun. 19, 1985

[30] Foreign Application Priority Data

Jun. 21, 1984 [FR] France ..... 84 09766

[51] Int. Cl.[4] ..... E04H 15/00; E04H 15/26

[52] U.S. Cl. ..... 135/99; 135/113; 135/905

[58] Field of Search ..... 52/745, 119, 123.1; 135/87, 95, 96, 98, 99, 106, 113–115, 112, 100, 101, 905; 47/21–23

[56] References Cited

U.S. PATENT DOCUMENTS

| | | | |
|---|---|---|---|
| 1,072,340 | 9/1913 | Liljegran | 47/21 |
| 2,356,085 | 8/1944 | Pfaff | 52/123.1 |
| 2,412,678 | 12/1946 | Goldman | 52/116 |
| 2,876,783 | 3/1959 | Ames | 135/99 |
| 3,626,836 | 12/1971 | Schneidler | 135/93 |
| 3,820,553 | 6/1974 | Huddle | 135/103 |
| 3,961,638 | 6/1976 | Huddle | 135/97 |
| 4,000,750 | 1/1977 | Becher | 135/16 |

FOREIGN PATENT DOCUMENTS

| | | | |
|---|---|---|---|
| 2339640 | 2/1975 | Fed. Rep. of Germany . | |
| 560027 | 4/1944 | United Kingdom . | |
| 588208 | 5/1947 | United Kingdom . | |
| 571431 | 9/1977 | U.S.S.R. | 52/745 |
| 586118 | 12/1977 | U.S.S.R. | 52/745 |

*Primary Examiner*—James R. Feyrer

*Attorney, Agent, or Firm*—Sandler & Greenblum

[57] ABSTRACT

For mounting a light shelter of the type having a central pole which supports a cloth forming the shelter roof, the pole is placed flat on the ground with its lower end mounted for pivoting around a horizontal axis, the cloth is slipped over the pole, and the pole, carrying the cloth, is pivoted around said axis to vertical position.

The device comprises a base for pivotally supporting the pole, a hoisting cable attached to the pole between the ends thereof, extending in a plane perpendicular to the pivot axis over support at a distance above the base, and being in engagement with a cable pulling device which in turn is anchored to the ground.

7 Claims, 4 Drawing Figures

METHOD AND DEVICE FOR MOUNTING THE POLE AND CLOTH OF A LIGHT SHELTER WITH CENTRAL POLE

BACKGROUND OF THE INVENTION

The present invention relates to a method and a device for mounting the pole and cloth of a light shelter with central pole.

Light shelters are previously known which comprise a vertical central pole which supports, at its upper end, the top position of a cloth which forms the roof and which, along its lower peripheral edge, rests on the ground, on a circular support, on lateral posts which are in turn secured to the ground. Theretofore, the mounting of light shelters of this type has necessitated the use of a hoisting machine, such as a crane, for placing the central pole in vertical position, and thereafter the cloth has been raised progressively around the central pole, the cloth being provided in its central position with an opening through which the pole extends, which permits the vertical displacement of the cloth in the direction of the top of the pole during the raising of the cloth.

It is obvious that such a method is not very convenient. It is also cumbersome because it requires the presence, at the place where the shelter is to be erected, of a hoisting machine such as a crane. It is not always convenient to have such a machine present, and, furthermore, it is relatively expensive to rent such machines.

SUMMARY OF THE INVENTION

The present invention has for its object to overcome these inconveniences by providing a mounting method and device offering great simplicity of use and not necessitating the use any of hoisting machine.

To this end this method of mounting a light shelter comprising a vertical, central pole having its lower end supported on the ground and supporting, at its upper end, the central top portion of a cloth forming the roof of the shelter, the method consists in:

(a) supporting the lower end of said pole for pivoting around a horizontal axis at approximate ground level;

(b) placing said pole flat on the ground;

(c) slipping said cloth over said pole to position said central, top portion of the cloth on said upper end of the pole; and (d) pivoting the pole carrying the cloth around said horizontal axis until the pole has reached vertical position.

This invention relates also to a device for mounting a light shelter having a vertical central pole supporting a cloth forming the roof of the shelter, the device comprising a base resting on the ground, the lower end of said pole being mounted in said base for pivoting around a horizontal axis, a hoisting cable extending in a vertical plane through the pole and at right angles to said horizontal axis, means connecting said hoisting cable to said pole at a point between the ends thereof, means supporting said hoisting cable at a distance above said base, a cable pulling device engaging said hoisting cable, and means for anchoring said cable pulling device to the ground.

The method and the device according to the invention thus makes it possible to mount a light shelter using only very simple means, such as a manually operated cable pulling device for pivoting the pole. The necessity of having recourse to a hoisting machine is thereby avoided.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 4:
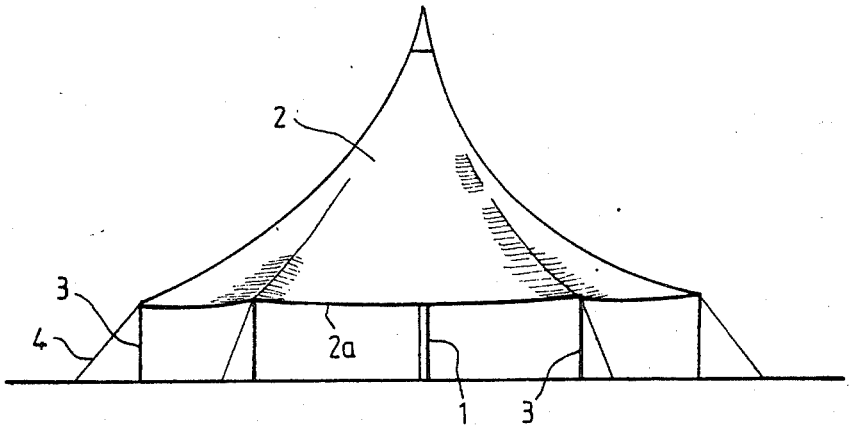
FIG. 4 is a side view of the light shelter in its mounted condition.

The light shelter which is to be mounted using the method and the device according to the invention comprises a central pole 1 carrying at its upper end 1*a* the central portion of a cloth 2 adapted to form the roof of the shelter shown in FIG. 4. In this non-limitative embodiment the cloth 2 is attached, along its lower edge 2*a*, to a number of peripheral posts 3 which are evenly distributed around the vertical axis of the shelter and which are in turn held in position by stays 4 secured to the ground.

According to the invention, the pole 1 is mounted for pivoting, at its lower end 1*b*, around a horizontal axis xx' carried by a base 5 placed on the ground at the centre of the support polygon defined by the peripheral posts 3.

The pole 1 is placed flat on the ground, and at right angles to the pivot axis xx' before the raising operation. At its upper side the pole 1 is provided with an attachment means 6, such as an eyelet, to which are attached two ropes 7, 7*a*, the ends of which are secured to the ground at points 8 and 9, respectively, situated on the pivot axis xx' of the pole 1 and on opposite sides of the pole. The points 8, 9 also serve for securing stays 4 holding two diametrically opposed peripheral posts 3 situated substantially on the pivot axis xx' of the pole 1.

A hoisting cable 11, which extends in a vertical plane coinciding with the longitudinal direction of the pole 1, is also attached to the eyelet 6 carried by the pole 1, passes at a certain height above the base 5 supported by a support 12, and is connected to a cable pulling device 13 of the type known under the name "TIRFOR". The pulling device 13 is in turn connected to an anchoring point 14 in the ground by means of a connecting means 15, such as a cable.

Figure 1:
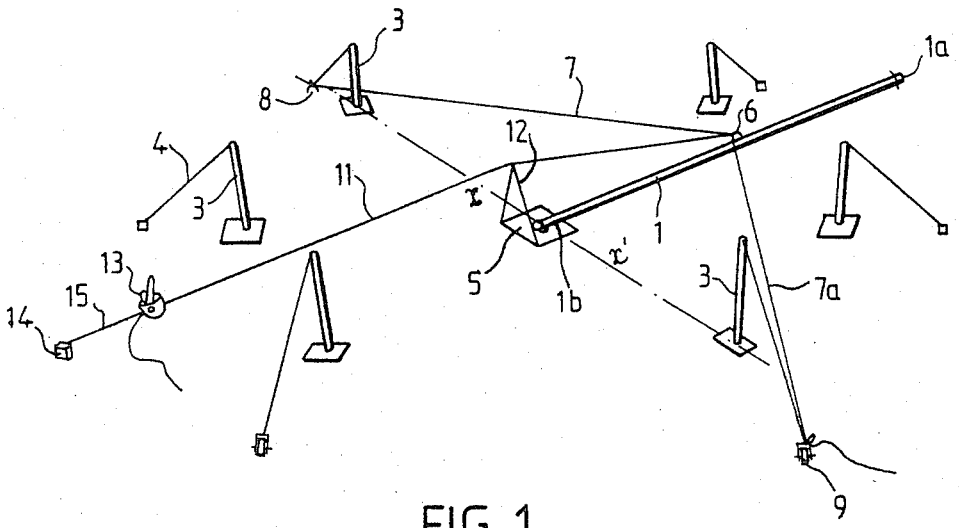
FIG. 1 is a perspective view of the central pole of a shelter positioned flat on the ground before beginning of the raising operation.
Figure 2:
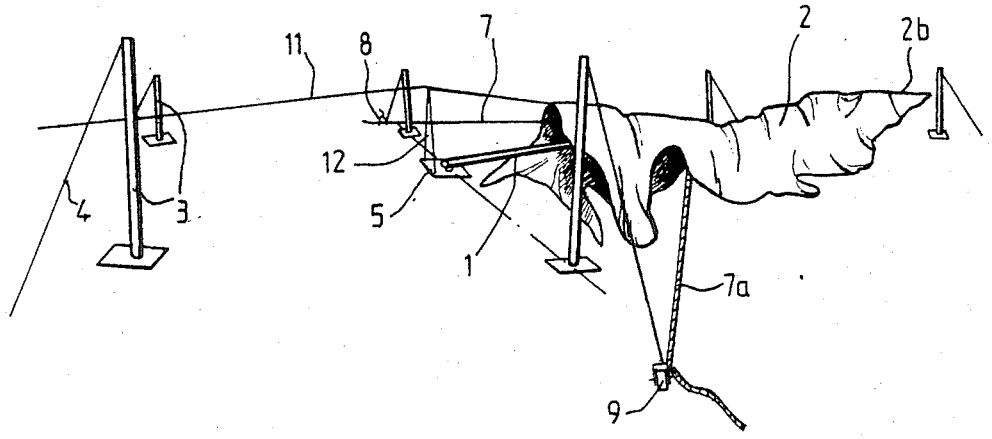
FIG. 2 is a perspective view of the pole lying flat on the ground with the cloth forming the roof of the shelter pushed over the pole, before the raising operation.

Before starting the operation of raising the shelter, the cloth 2 which is to form the roof of the shelter, is slipped over the pole 1 in such a manner that its central portion 2*b*, which is for example in the form of a conical cap, will be positioned on the upper, movable end of the pole while this is still on the ground. The cloth will then be fitted as illustrated in FIG. 2.

Figure 3:
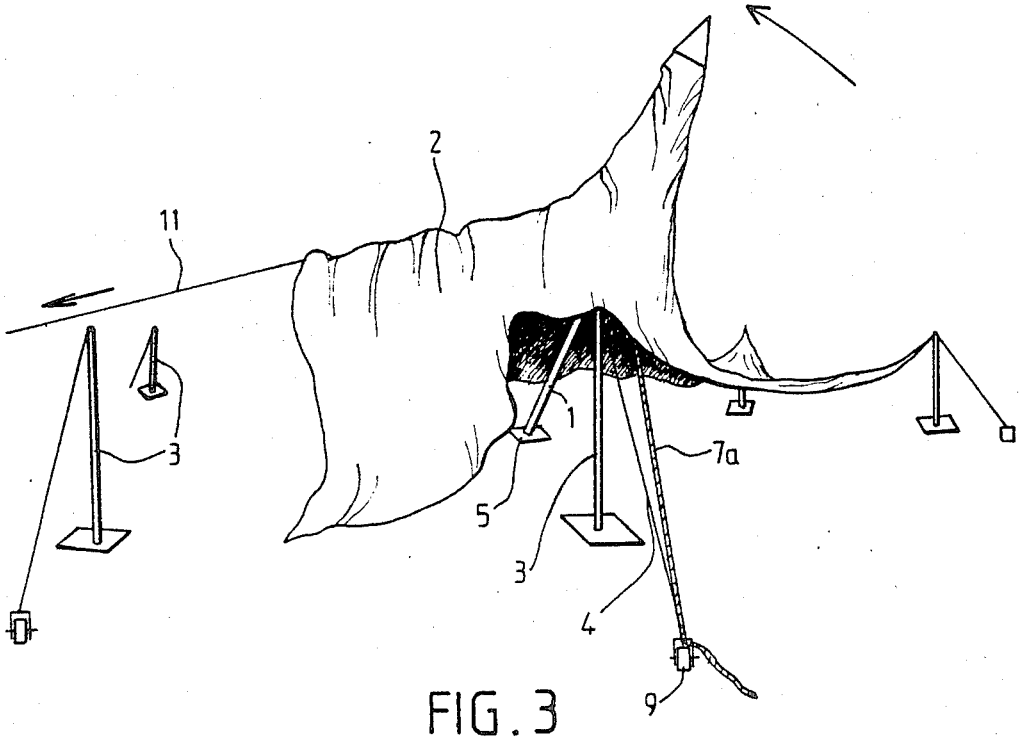
FIG. 3 is a perspective view of the pivoting pole and the cloth during the raising operation.

Thereafter, as illustrated in FIG. 3, cloth 2 is attached to peripheral posts 3 situated on the side opposite pulling device 13. Then, the pole 1 is raised by operating the cable pulling device 13 to progressively pull in the cable 11. The pulling force is transmitted by the eyelet 6 to the pole 1 which then pivots around the axis xx' towards the vertical direction. During this pivoting movement the pole 1 carries with it the cloth 2, as illustrated in FIG. 3.

The ropes 7 and 7*a*, which are stretched between the eyelet 6 on the pole 1 and the ground anchoring points 8 and 9, respectively, assure that the pole 1 is maintained in the vertical plane at right angles to the axis xx' during the pivoting movement of the pole around said axis.

After having been pivoted through 90°, the pole is situated in the vertical position, and t is then sufficient to connect the lower edge of the cloth 2 to the upper ends of the posts 3 and to stretch the cloth by any suitable means.

From the above description it should be obvious that the mounting of the whole shelter is considerably simplified in comparison with the previously known method which necessitates the use of a hoisting machine.

What I claim is:

1. A method of mounting a tent, said tent comprising a vertical, central pole having its lower first end pivotably supported on a stationary base on the ground and supporting at its upper second end, the central top portion of a cloth forming a roof of said tent, the method comprising:

(a) mounting the lower first end of said pole on a stationary base on the ground, to pivot around a horizontal axis at approximately ground level;
(b) placing said pole flat on the ground;
(c) attaching one end of a single hoisting cable to said pole at a point between the ends thereof;
(d) extending said single hoisting cable in a vertical plane along said pole and at a right angle to said horizontal axis;
(e) at least temporarily supporting said single hoisting cable above said base, on a stationary support fixedly attached to said base;
(f) engaging the other end of said single hoisting cable to a cable pulling device;
(g) anchoring said cable pulling device to the ground;
(h) slipping a cloth over said pole to position said central, top portion of the cloth on said upper second end of said pole;
(i) pivoting said pole carrying the cloth around said horizontal axis until said pole has reached the vertical position; and
(j) controlling the ascent of said pole by said single cable and said cable pulling device.

2. A method according to claim 1, further comprising attaching part of said cloth to peripheral parts opposite said hoisting cable.

3. A method according to claim 1, further comprising maintaining said pole in one and the same vertical plane at a right angle to said horizontal axis while pivoting said pole around said axis by tensionally supporting said pole by a single pair of guide means, one guide of said guide means symmetrically positioned on a side of said pole opposite the other side of said guide means.

4. A method according to claim 3, wherein said guide means comprises cables, attached at a first end to said pole and anchored to the ground at a second end.

5. A method of mounting a tent, said shelter tent comprising a vertical, central pole having its lower first end supported on the ground and supporting, at its upper second end, the central top portion of a cloth forming a roof of said tent, the method comprising:

(a) mounting the lower first end of said pole on a stationary base on the ground, to pivot around a horizontal axis at approximate ground level;
(b) placing said pole flat on the ground;
(c) attaching one end of a single hoisting cable to said pole at the point between the ends thereof;
(d) slipping said cloth over said pole to position said central, top portion of said cloth on said upper second end of said pole;
(e) attaching said cloth to peripheral posts of the side opposite said single hoisting cable;
(f) at least temporarily supporting said single hoisting cable above said base, on a stationary support fixedly attached to said base;
(g) pivoting said pole carrying said cloth around said horizontal axis until said pole has reached the vertical position;
(h) controlling the ascent of said pole by a single cable hoisting means;
(i) guiding the ascent of said pole by a single pair of guide ropes anchored to the ground; and
(j) attaching remaining portions of said cloth to peripheral posts encircling the pole.

6. A manually erectable tent installation having a vertical central pole supporting a cloth forming the roof of the tent, the installation comprising a base adapted to be fixedly stationed on the ground, the lower first end of a pole being mounted in said base and pivotable around a horizontal axis, a cloth mounted on the second end of said pole, a single hoisting cable extending in a vertical plane along said pole and at a right angle to said horizontal axis, means connecting said single hoisting cable to said pole at a point between the ends thereof, stationary means fixedly attached to said base supporting said single hoisting cable at a distance above said base, a cable pulling device engaging said single hoisting cable, and means for anchoring said cable pulling device to the ground.

7. A device according to claim 4, further comprising a single pair of ropes, each rope connected at one end to said pole at the point where said hoisting cable is connected and means for anchoring the other ends of said ropes to the ground at points situated on said pivot axis and on opposite sides of said pole.

* * * * *